US006595799B2

(12) United States Patent
Yao

(10) Patent No.: US 6,595,799 B2
(45) Date of Patent: Jul. 22, 2003

(54) STRUCTURE OF CONTACT PIECE FOR CABLE TELEVISION SIGNALS

(75) Inventor: Tien Shou Yao, Taipei (TW)

(73) Assignee: Taiwan Gamma Electronic Inc., Taipei (TW)

( * ) Notice: Subject to any disclaimer, the term of this patent is extended or adjusted under 35 U.S.C. 154(b) by 0 days.

(21) Appl. No.: 10/020,902

(22) Filed: Dec. 19, 2001

(65) Prior Publication Data

US 2003/0114047 A1 Jun. 19, 2003

(51) Int. Cl.[7] ..... H01R 9/05
(52) U.S. Cl. ..... 439/578; 439/857
(58) Field of Search ..... 439/578–585, 439/638, 857, 856

(56) References Cited

U.S. PATENT DOCUMENTS 3,838,388 A * 9/1974 Bauerle et al. ..... 439/857
4,878,862 A * 11/1989 Wise ..... 439/857
5,024,627 A * 6/1991 Bennett et al. ..... 439/857
5,957,734 A * 9/1999 Gladd et al. ..... 439/857
6,000,975 A * 12/1999 Feldman ..... 439/857
6,113,431 A * 9/2000 Wong ..... 439/638
6,276,970 B1 * 8/2001 Wong ..... 439/578
6,299,479 B1 * 10/2001 Tang ..... 439/578
6,336,832 B2 * 1/2002 Nobe ..... 439/578

* cited by examiner

*Primary Examiner*—Gary Paumen
(74) *Attorney, Agent, or Firm*—Dennison, Shultz & Dougherty

(57) ABSTRACT

An improved structure of a contact piece for cable television signals, the structure is characterized by: the contact piece is formed by lapping and engaging of two identical and very thin sheets and enveloping the contact piece in a plastic insulating pipe and then placing it with the pipe in a housing of the end connector formed integrally, in this way, manufacturing of the cable television end connector is completed. The very thin sheets of the contact piece can largely reduce the characteristic impedance to thereby increase the propagating rate of the contact piece.

2 Claims, 6 Drawing Sheets

STRUCTURE OF CONTACT PIECE FOR CABLE TELEVISION SIGNALS

BACKGROUND OF THE INVENTION

1. Field of the Invention

The present invention is related to an improved structure of a contact piece for cable television signals, and especially to such a structure of which the electric characteristic impedance of the contact piece is largely reduced, the propagating rate of the contact piece is increased. The improved structure of a contact piece especially suits a system with characteristic impedance of 750 hm to elevate quality of cable television transmission.

2. Description of the Prior Art

Referring to FIG. 1 and 2 showing the structure of a contact piece of a conventional end connector, the contact piece "A" is a member integrally formed, it is comprised mainly of a front piece Al and a rear piece A2 with a connecting portion A3 at the middle of them. The front and the rear pieces A1, A2 are folded into undulated forms at the upper and the lower areas of the connecting portion A3, the connecting portion A3 then is folded at the middle thereof to lap the front piece A1 over the rear piece A2 matchably to form an upper and a lower inserting portion to be inserted into two insulation pipes and a housing to form the conventional cable television end connector.

Such a conventional contact piece "A" is more convenient in manufacturing, however, a certain thickness is required for an integrally molded piece, while a medium for transmitting signals has its propagation constant $\gamma$ decided by its characteristic impedance Zo, and the characteristic impedance of the propagating medium is decided by four parameters including the impedance R, the conductance G, the inductive reactance L and the capacitive reactance C of the transmitting medium. By the fact that:

$$Zo=\sqrt{R+jwL/G+jwC}\,(w=2\pi f),$$

$$\gamma=\sqrt{(R+jwL)(G+jwC)}=\alpha+j\beta,$$

wherein, $\alpha$ is a scalar quantity called decay constant;

$\beta$ is an imaginary quantity called phase shift constant;

$\alpha$, $\beta$ respectively decide the incident loss and the return loss of the transmitting medium system, hence goodness and badness of a contact piece is decided by a conductor itself and the inner chamber of a copper pipe which decide the four parameters R, G, L and C, and in turn decide the propagation constant $\gamma$ (please refer to the attachment 1). Incident losses and return losses of conventional contact pieces are all inferior, and thereby are undesired.

Therefore, it is the motive of the present invention to eliminate the defects resided in the contact pieces of conventional end connectors, and to provide a contact piece formed by lapping and engaging of two identical and very thin sheets and enveloping the contact piece in a plastic insulating pipe and then placing it with the pipe in a housing of the end connector formed integrally, in this way, manufacturing of the cable television end connector is completed. The very thin sheets of the contact piece can largely reduce the characteristic impedance to thereby increase the propagating rate.

SUMMARY OF THE INVENTION

The primary object of the present invention is to provide an improved structure of a contact piece for cable television signals of which the characteristic impedance is largely reduced.

The secondary object of the present invention is to provide an improved structure of a contact piece for cable television signals of which the propagating rate is increased.

To achieve the above stated objects, the present invention is characterized by: the contact piece thereof is formed by lapping and engaging of two identical and very thin sheets and enveloping the contact piece in a plastic insulating pipe and then placing it with the pipe in a housing of the end connector formed integrally, in this way, manufacturing of a cable television end connector is completed. The very thin sheets of the contact piece can largely reduce the characteristic impedance to thereby increase the propagating rate.

The present invention will be apparent after reading the detailed description of the preferred embodiment thereof in reference to the accompanying drawings.

DETAILED DESCRIPTION OF THE PREFERRED EMBODIMENT

Figure 3:
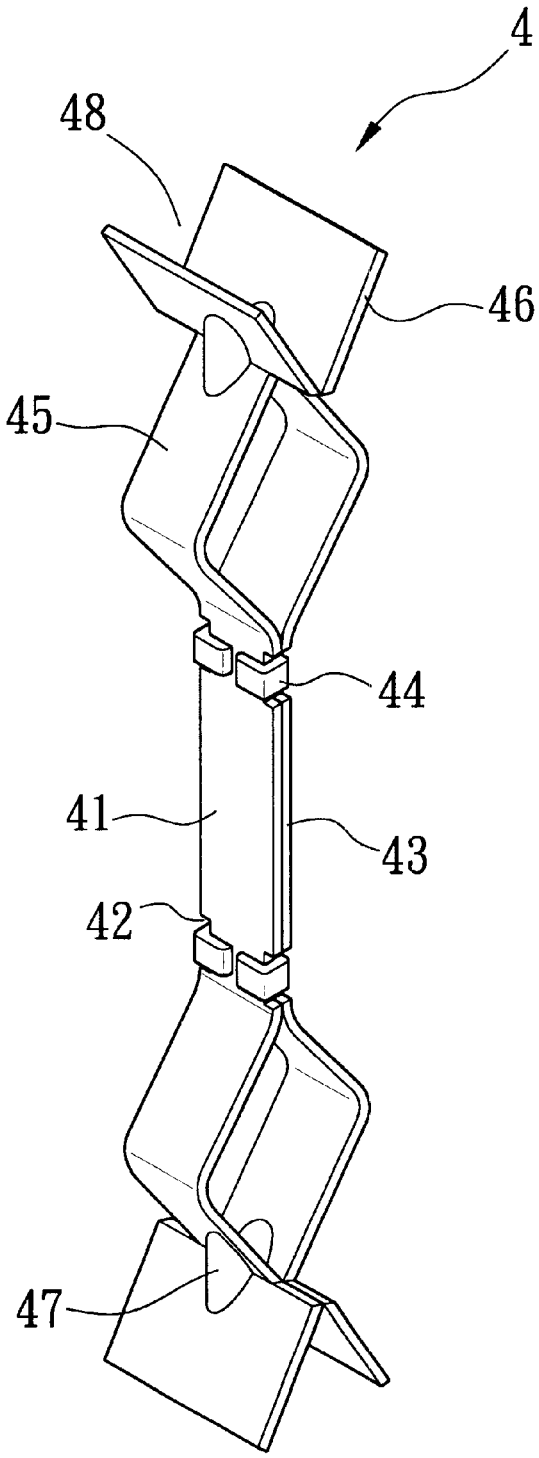
FIG. 3 is a perspective view of an end connector of the present invention.
Figure 4:
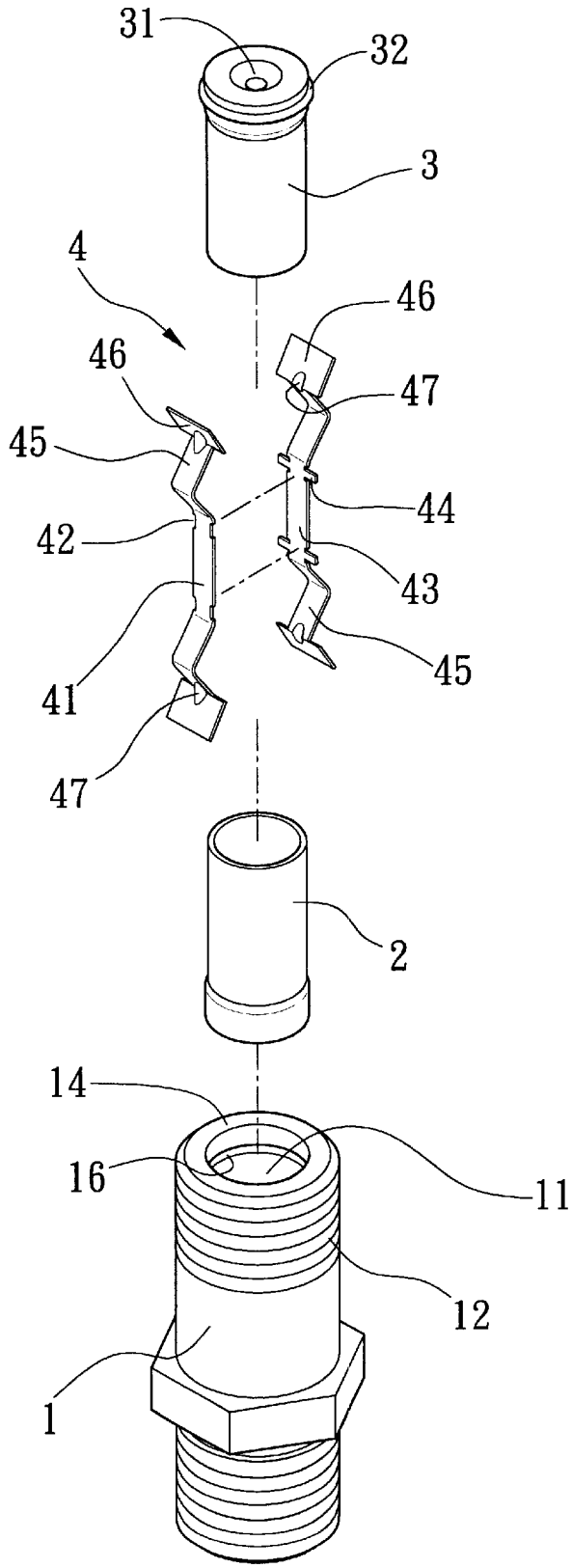
FIG. 4 is an analytical perspective view showing the elements of the end connector of the present invention.
Figure 5:
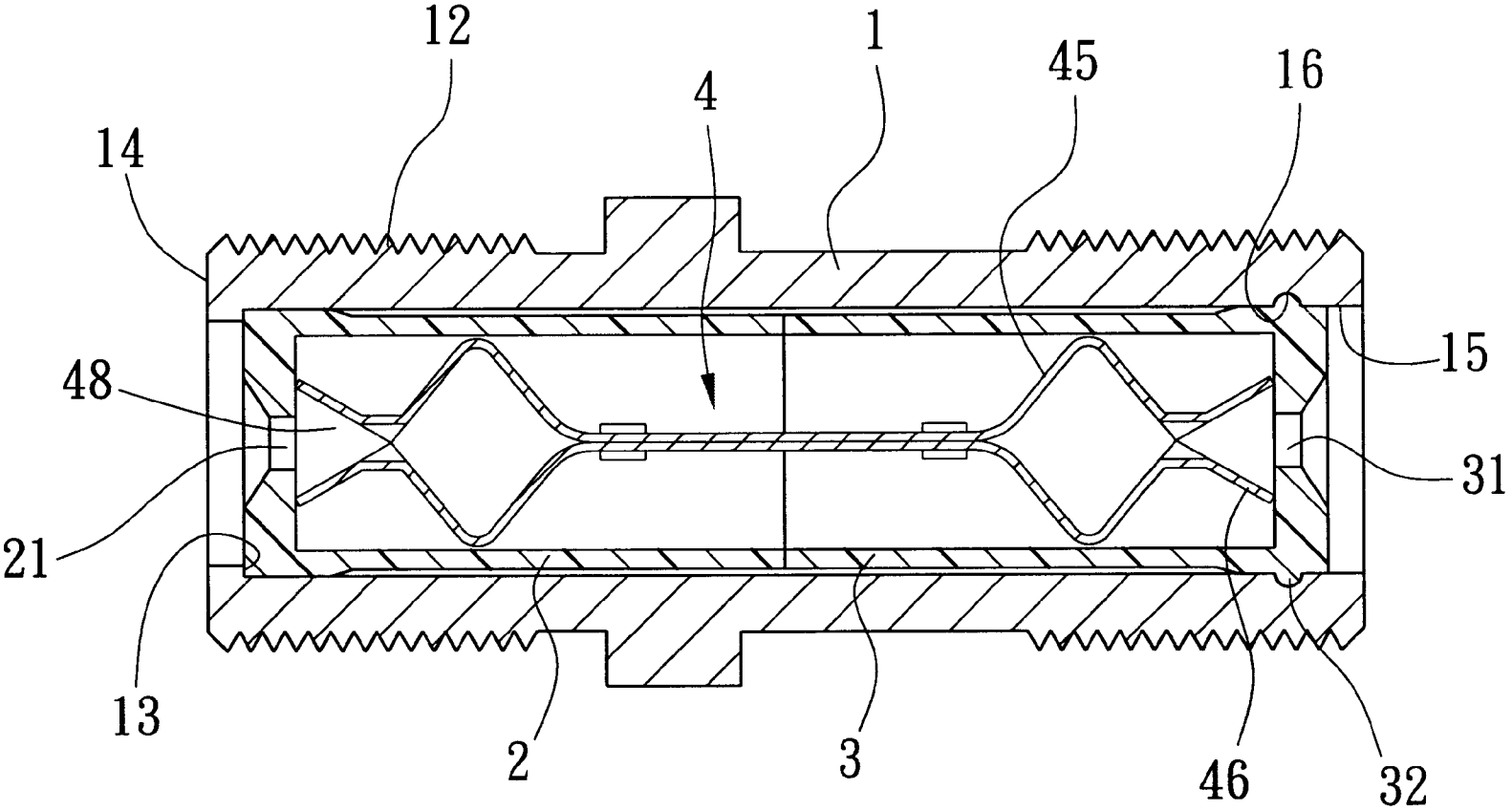
FIG. 5 is a sectional view of an embodiment of the present invention.

Referring firstly to FIGS. 3–5, the improved structure of a contact piece for cable television signals of the present invention is mainly comprised of a contact piece 4 engaging with a housing 1 of the end connector and two plastic insulating pipes 2, 3 to make these members integral.

The contact piece 4 is comprised of a front piece 41 and a rear piece 43 lapping with each other; the front piece 41 has at the middle thereof two pair of notches 42, while the rear piece 43 has at the middle thereof two pair of protrusions 44. The front and rear pieces 41, 43 are both provided outwardly from the notches 42 and the protrusions 44 with folded portions 45 which are extended on the ends thereof to form end folding portions 46. Each end folding portion 46 has at the central root area thereof a recess 47. When the front and rear pieces 41, 43 are aligned with each other, the protrusions 44 of the rear piece 43 are bent inwardly to envelop the notches 42, so that the front piece 41 is firmly positioned by the rear piece 43, and the two end folding portions 46 at the two ends of the front and rear pieces 41, 43 form an insertion connecting portion 48.

The plastic insulating pipes include the front pipe 2 and the rear pipe 3, wherein, the two pipes 2, 3 are provided respectively with a hole 21 and a hole 31, and has their pipe heads slightly larger than their shanks, a passage is provided in each pipe 2 or 3 fitting the contact piece 4; and the end of the pipe head of the insulating pipe 3 has an annular flange 32 surrounding the pipe head.

The housing 1 of the end connector is a short pipe with a suitable length and is integrally formed, the front and the read ends of the short pipe are both provided with a thread 12 of a suitable length, and are both provided with a passage 11. Wherein, an end of the short pipe is provided with a stop edge 13 extending toward the center of the housing 1 in order that a threaded connecting portion 14 can have a larger area; while the other end is provided on the inner wall thereof with an annular groove 16. This other end is also provided with a threaded connecting portion 15.

The head of the insulating front pipe 2 is placed in the passage 11 of the housing 1 firstly to abut the head against the stop edge 13 extending toward the center of the housing 1, then the contact piece 4 is placed in the passage of the insulating front pipe 2 already placed in the passage 11 of the housing 1, lastly, the tailing end of the insulating rear pipe 3 is placed in the passage 11 of the housing 1 to envelop the contact piece 4 therein. By the elasticity of plastic, the annular flange 32 surrounding the pipe head of the insulating rear pipe 3 is engaged in the annular groove 16 of the housing 1. Therefore, the contact piece 4 and the front and rear pipes 2, 3 are all positioned in the housing 1 of the end connector and are firmly held to get an integral unit, there is no requirement of processes for further pressing combination or adding a cover, and a tidy end connector with the threaded connecting portions 14, 15 can be obtained.

Figure 1:
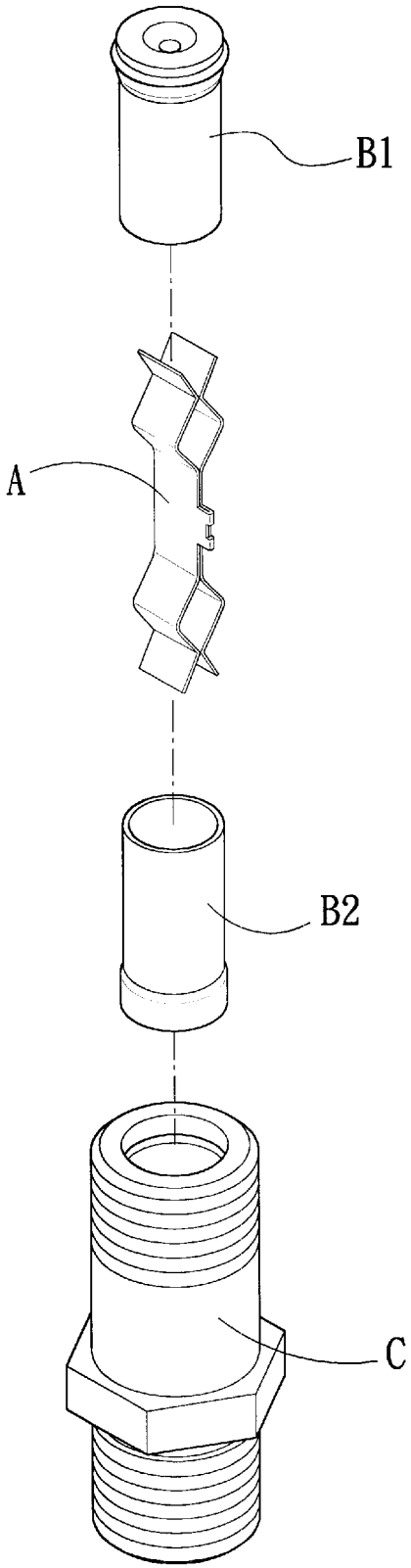
Fig. 1 Prior Art
FIG. 1 is an analytical perspective view showing the elements of a conventional end connector.
Figure 2:
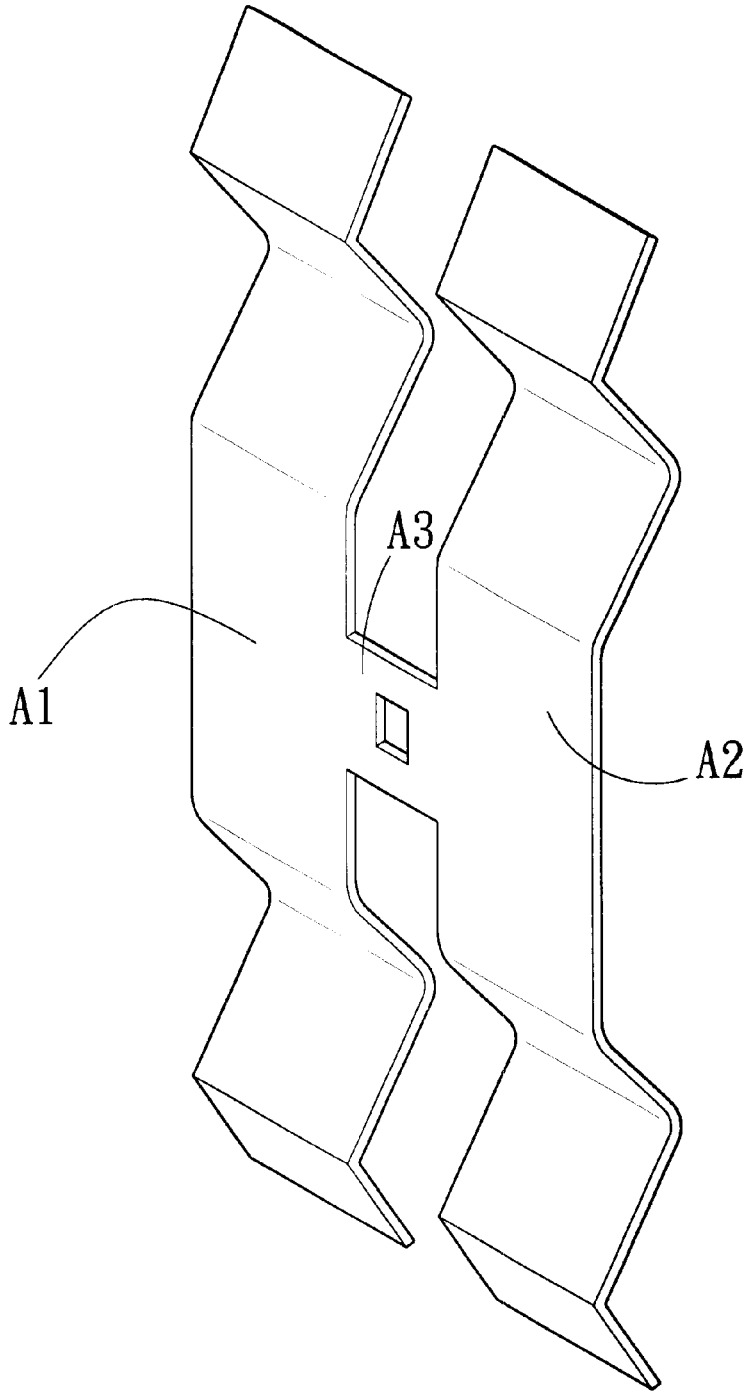
Fig. 2 Prior Art
FIG. 2 is a perspective view of the conventional end connector being spread out.
Figure 6:
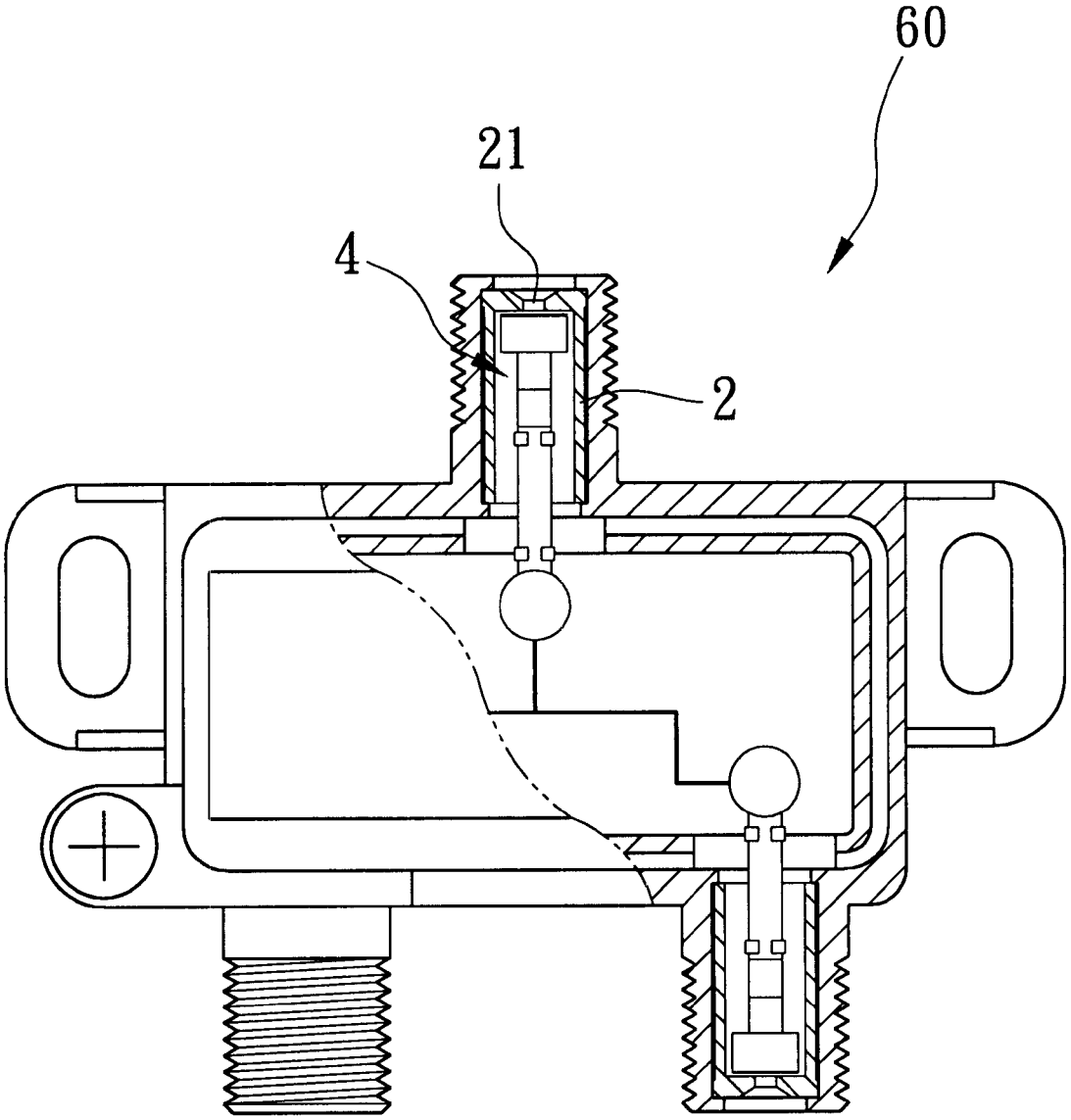
FIG. 6 is a sectional schematic view of another embodiment of the present invention.

The present invention especially suits a manifold pipe 60 (as shown in FIG. 6), a conventional manifold pipe has a contact piece "A" with a large area as shown in FIG. 1 placed in advance in an elongate cylinder protruding from the manifold pipe, it can not have its characteristic impedance lowered, thereby, its propagating rate can not be increased. While using the contact piece 4 of the present invention makes large reducing of the area of engagement of the front piece 41 with the rear piece 43, thus characteristic impedance can be effectively lowered (please refer to the attachment 1) and propagating rate can be increased relatively, thereby, quality of transmission of the cable can be elevated.

In conclusion, the present invention is novel as a whole as compared to the structures of now available contact pieces, and functions of it is evidently improved.

My invention is to be construed as including all modifications and variations falling within the scope of the appended claims.

What is claimed is:

1. An improved structure of a contact piece for cable television signals, said structure characterized by:

said contact piece having two abutting, substantially identical, very thin metal sheets which are received in a plastic pipe, the plastic pipe then being inserted into an end connector housing; said very thin sheets largely reducing the characteristic impedance of the contact piece; a first of said two sheets having at the middle thereof two pairs of notches, and a second of said sheets having at the middle thereof two pairs of protrusions which are bent into the respective notches of the first sheet to secure the two sheets together, the ends of the sheets being flared outwardly.

2. An improved structure of a contact piece for cable television signals as in claim 1, wherein, said bent portions each have at a central root area thereof a recess.

* * * * *